US006025119A

United States Patent [19]

Majumdar et al.

[11] Patent Number: 6,025,119

[45] Date of Patent: Feb. 15, 2000

[54] ANTISTATIC LAYER FOR IMAGING ELEMENT

[75] Inventors: Debasis Majumdar; Dennis J. Savage, both of Rochester; Dennis J. Eichorst, Fairport; Thomas N. Blanton, Rochester, all of N.Y.

[73] Assignee: Eastman Kodak Company, Rochester, N.Y.

[21] Appl. No.: 09/216,187

[22] Filed: Dec. 18, 1998

[51] Int. Cl.[7] ..... G03C 1/89

[52] U.S. Cl. ..... 430/529; 430/527; 430/530

[58] Field of Search ..... 430/527, 530, 430/529

[56] References Cited

U.S. PATENT DOCUMENTS

| | | | |
|---|---|---|---|
| 4,173,480 | 11/1979 | Woodward | 430/536 |
| 4,275,103 | 6/1981 | Tsubusaki et al. . | |
| 4,394,441 | 7/1983 | Kawaguchi et al. . | |
| 4,416,963 | 11/1983 | Takimoto et al. . | |
| 4,418,141 | 11/1983 | Kawaguchi et al. . | |
| 4,431,764 | 2/1984 | Yoshizumi . | |
| 4,442,168 | 4/1984 | White et al. . | |
| 4,495,276 | 1/1985 | Takimoto et al. . | |
| 4,571,361 | 2/1986 | Kawaguchi et al. . | |
| 4,571,365 | 2/1986 | Ashlock et al. . | |
| 4,731,408 | 3/1988 | Jasne . | |
| 4,880,703 | 11/1989 | Sakamoto et al. . | |
| 4,937,060 | 6/1990 | Kathiragamanathan et al. . | |
| 4,956,441 | 9/1990 | Kathirgamanthan et al. . | |
| 4,987,042 | 1/1991 | Jonas et al. . | |
| 4,999,276 | 3/1991 | Kuwabara et al. . | |
| 5,093,439 | 3/1992 | Epstein et al. . | |
| 5,122,445 | 6/1992 | Ishigaki . | |
| 5,204,219 | 4/1993 | Van Ooij et al. . | |
| 5,236,818 | 8/1993 | Carlson . | |
| 5,273,822 | 12/1993 | Hayashi et al. . | |
| 5,294,525 | 3/1994 | Yamauchi et al. . | |
| 5,300,573 | 4/1994 | Patel . | |
| 5,312,681 | 5/1994 | Muys et al. . | |
| 5,340,676 | 8/1994 | Anderson et al. . | |
| 5,350,448 | 9/1994 | Dietz et al. . | |
| 5,354,613 | 10/1994 | Quintens et al. . | |
| 5,368,995 | 11/1994 | Christian et al. . | |
| 5,370,981 | 12/1994 | Krafft et al. | 430/529 |
| 5,372,924 | 12/1994 | Quintens et al. . | |
| 5,382,494 | 1/1995 | Kudo et al. . | |
| 5,391,472 | 2/1995 | Muys et al. . | |
| 5,403,467 | 4/1995 | Jonas et al. . | |
| 5,443,944 | 8/1995 | Krafft et al. . | |
| 5,459,021 | 10/1995 | Ito et al. . | |
| 5,466,567 | 11/1995 | Anderson et al. . | |
| 5,478,709 | 12/1995 | Vandenabeele | 430/527 |
| 5,484,694 | 1/1996 | Lelental et al. . | |
| 5,494,738 | 2/1996 | Van Thillo et al. | 430/527 |
| 5,575,898 | 11/1996 | Wolf et al. . | |
| 5,585,037 | 12/1996 | Linton | 252/518 |
| 5,628,932 | 5/1997 | Linton . | |
| 5,665,498 | 9/1997 | Savage et al. . | |
| 5,674,654 | 10/1997 | Zumbulyadis et al. | 430/536 |
| 5,679,505 | 10/1997 | Tingler et al. | 430/531 |
| 5,700,623 | 12/1997 | Anderson et al. . | |
| 5,716,550 | 2/1998 | Gardner et al. | 252/500 |
| 5,869,217 | 2/1999 | Aono | 430/527 |
| 5,869,227 | 2/1999 | Majumdar et al. | 430/527 |
| 5,891,611 | 4/1999 | Majumdar et al. | 430/527 |

FOREIGN PATENT DOCUMENTS

| | | |
|---|---|---|
| 250154 | 12/1987 | European Pat. Off. . |
| 644454 | 3/1995 | European Pat. Off. . |
| 2194071 | 7/1990 | Japan . |
| 4055492 | 2/1992 | Japan . |
| 6167778 | 6/1994 | Japan . |

*Primary Examiner*—Richard L. Schilling
*Attorney, Agent, or Firm*—Carl F. Ruoff

[57] ABSTRACT

The present invention is an imaging element which includes a support, an image-forming layer superposed on the support, and an electrically-conductive layer superposed on the support. The electrically-conductive layer includes a layered siliceous material, an electrically conducting polymer that can intercalate inside or exfoliate said layered siliceous material and a film-forming binder.

17 Claims, 2 Drawing Sheets

ANTISTATIC LAYER FOR IMAGING ELEMENT

FIELD OF THE INVENTION

This invention relates in general to imaging elements which include a support, an image forming layer and an electrically-conductive layer. More specifically, this invention relates to electrically-conductive layers containing a layered siliceous material, an electrically-conducting polymer that can intercalate inside and/or exfoliate the layered siliceous materials and a film forming polymeric binder.

BACKGROUND OF THE INVENTION

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. The static problems have been aggravated by increases in the sensitivity of new emulsions, increases in coating machine speeds, and increases in post-coating drying efficiency. The charge generated during the coating process may accumulate during winding and unwinding operations, during transport through the coating machines and during finishing operations such as slitting and spooling. Static charge can also be generated during the use of the finished photographic film product. In an automatic camera, the winding of roll film in and out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during photographic processing, resulting in a loss of antistatic function. The conductivity of antistatic layers employing an electronic conductor depends on electronic mobility rather than ionic mobility and is independent of humidity.

Antistatic layers which contain semiconductive metal halide salts, semiconductive metal oxide particles, etc., have been described previously. However, these antistatic layers typically contain a high volume percentage of electronically conducting materials which are often expensive and impart unfavorable physical characteristics, such as color or reduced transparency, increased brittleness and poor adhesion, to the antistatic layer.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and suicides have been disclosed in Japanese Kokai No. JP 04-055,492.

One serious deficiency of such granular electronic conductor materials is that, especially in the case of semiconductive metal-containing particles, the particles usually are highly colored which render them unsuitable for use in coated layers on many photographic supports, particularly at high dry weight coverage. This deficiency can be overcome by using composite conductive particles composed of a thin layer of conductive metal-containing particles deposited onto the surface of non-conducting transparent core particles whereby a lightly colored material with sufficient conductivity is obtained. For example, composite conductive particles composed of two dimensional networks of fine antimony-doped tin oxide crystallites in association with amorphous silica deposited on the surface of much larger, non-conducting metal oxide particles (e.g., silica, titania, etc.) and a method for their preparation are disclosed in U.S. Pat. Nos. 5,350,448; 5,585,037 and 5,628,932. Alternatively, metal-containing conductive materials, including composite conducting particles, with high aspect ratio can be used to obtain conducting coatings with lighter color due to reduced dry weight coverage (vide, for example, U.S. Pat. Nos. 4,880,703 and 5,273,822). However, there is difficulty in the preparation of conductive coatings containing composite conductive particles, especially the ones with high aspect ratio, since the dispersion of these particles in an aqueous vehicle using conventional wet milling dispersion techniques and traditional steel or ceramic milling media often result in wear of the thin conducting layer from the core particle and/or reduction of the aspect ratio. Fragile composite conductive particles often cannot be dispersed effectively because of limitations on milling intensity and duration dictated by the need to minimize degradation of the morphology and electrical properties as well as the introduction of attrition-related contamination from the dispersion process.

Moreover, these metal containing semiconductive particles, can be quite abrasive and cause premature damage to finishing tools, such as, knives, slitters, perforators, etc. and create undesirable dirt and debris which can adhere to the imaging element causing defects.

The requirements for antistatic layers in silver halide photographic films are especially demanding because of the stringent optical requirements. Other types of imaging elements such as photographic papers and thermal imaging elements also frequently require the use of an antistatic layer. However, the requirements there are somewhat different. For photographic paper, an additional criterion is the ability of the antistatic backing layer to receive printing (e.g., bar codes or other indicia containing useful information) typically administered by dot matrix or inkjet printers and to retain these prints or markings as the paper undergoes processing (viz., backmark retention). Yet another important criterion for photographic paper is its spliceability. Heat splicing of photographic paper rolls is often carried out during printing operations and is expected to provide sufficient mechanical strength to resist peeling as the web goes through automatic photographic processing. Heat splicing is typically carried out between the silver halide side of the paper and the antistatic backside of the paper. Poor splice strength can cause a number of problems including jamming of automatic processing equipment.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

An abrasion-resistant protective overcoat including a selected polyurethane binder, a lubricant, a matting agent, and a crosslinking agent overlying a conductive backing layer is described in U.S. Pat. No. 5,679,505 for motion picture print films; the abrasion-resistant protective overcoat contains a crosslinked polyurethane binder and, thus, provides a nonpermeable chemical barrier for antistatic layers containing, preferably, colloidal vanadium pentoxide antistatic agent which is known to degrade in contact with photographic processing solutions. Although U.S. Pat. No. 5,679,505 can provide certain advantages over conventional carbon black containing backing layers, the use of a crosslinking agent in the topcoat (without which the conductivity of the preferred antistatic layer will be jeopardized) poses some manufacturing concerns: crosslinked polyurethanes of U.S. Pat. No. 5,679,505 may impose additional constraints on the composition and pot-life of the coating solutions as well as other manufacturing parameters; from a health and safety standpoint, some crosslinking agents may require special handling and disposal procedures; removal of a crosslinked polyurethane layer can hinder recycling of the support.

As indicated above, the prior art on electrically-conductive layers in imaging elements is extensive and a very wide variety of different materials has been proposed for use as the electrically-conductive agent. There is still, however, a critical need in the art for improved electrically-conductive layers which are useful in a wide variety of imaging elements, which can be manufactured at reasonable cost, which are environmentally benign, which are durable and abrasion-resistant, which are effective at low coverage, which are adaptable to use with transparent imaging elements, which do not exhibit adverse sensitometric or photographic effects, and which maintain electrical conductivity even after coming in contact with processing solutions (since it has been observed in industry that loss of electrical conductivity after processing may increase dirt attraction to processed films which, when printed, may cause undesirable defects on the prints).

It is toward the objective of providing improved electrically-conductive layers that more effectively meet the diverse needs of imaging elements—especially of silver halide photographic films but also of a wide range of other imaging elements—than those of the prior art that the present invention is directed.

Use of smectite clay in imaging elements has been disclosed before. For example, in European Patent Application 0644454A1 use of synthetic smectite clay in an antistress layer for x-ray films has been disclosed. In U.S. Pat. No. 5,478,709 use of synthetic clay in the silver halide emulsion layer for reduction in roller marks during automatic processing has been described. The use of synthetic hectorite as an additive to a silica containing antistatic layer has been proposed before in U.S. Pat. Nos. 4,173,480 and 5,494,738. However, the integrity of these layers, when present as external layers, in contact with processing solutions during high speed processing is likely to be minimal resulting in loss of post-processing antistatic characteristic. In fact, some of the drawbacks of external antistatic layers containing a combination of hectorite clay and silica applied on photographic paper have been described in commonly assigned copending application Ser. No. 08/937,685. Although some binders have been mentioned in U.S. Pat. No. 4,173,480 for their use in conjunction with hectorite clay for application as a surface sizing agent for the fibrous paper base, the binders mentioned therein are hydrophilic binders such as gelatin, starch and methyl cellulose which are likely to offer little resistance to the processing solutions. The use of an organic compound which can intercalate inside and/or exfoliate smectite clay has been taught in commonly assigned copending applications U.S. Ser. Nos. 08/937,685 and 08/940,860 for application in antistatic layers containing smectite clay. The use of vinylidene halide based interpolymer binders for antistatic layers containing smectite clay has been taught in U.S. Ser. No. 08/992,857 such layers provide antiscumming properties as well as black and white process-surviving antistatic properties. However, none of these inventions can provide process-surviving antistatic characteristics after a typical color photographic processing.

Electrically conducting polymers have recently received attention from various industries because of their electronic conductivity. Some of these electrically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550 and 5,093,439) provide electronic conductivity instead of ionic conductivity, and, hence are conducting even at low humidity. Unlike metal-containing semiconducting particulate antistatic materials (e.g., antimony-doped tin oxide), the aforementioned electrically conducting polymers are less abrasive and environmentally more acceptable due to absence of heavy metals. However, one disadvantage of such polymers is their color which can prohibit their use in certain photographic applications.

Use of inorganic "powdery or granular" material coated with a conducting polymer has been disclosed in U.S. Pat. Nos. 4,937,060 and 4,956,441. However, the optical properties of the granular material and their suitability for application as transparent coatings for imaging application have not been addressed in these patents. Moreover, the processes described in U.S. Pat. Nos. 4,937,060 and 4,956,441 involved polymerization of the electrically conducting polymer in the presence of the granular material leading to a solid mass that needed to be separated and processed further for its end-use, unlike the present invention to be described in detail hereinbelow.

Japanese patent application JP2194071 A disclosed non-conductive pigment coated with conductive polymers for possible use as conductive primers for coating electrostatically non-conductive materials but required the use of an additional conductive filler such as metal powders, semi-conducting metal oxide powder, carbon black, etc.

Japanese patent application JP 6167778 A disclosed antistatic films containing amorphous powder and an electro-conductive polymer but did not teach of a layered siliceous material which is crystalline and can host an electrically conducting polymer through intercalation, as per the present invention. Moreover, given the ionic nature of the disclosed electroconductive polymers, it is unlikely that the antistatic films of JP 6167778 A would survive a color photographic processing.

As will be demonstrated hereinbelow, the present invention provides an auxiliary layer to an imaging element, with antistatic characteristics, before and after a typical color photographic processing, with or without a protective top-coat.

SUMMARY OF THE INVENTION

The present invention is an imaging element which includes a support, an image-forming layer superposed on the support, and an electrically-conductive layer superposed on the support. The electrically-conductive layer includes a layered siliceous material, an electrically conducting polymer that can intercalate inside or exfoliate said layered siliceous material and a film-forming binder.

Figure 1:
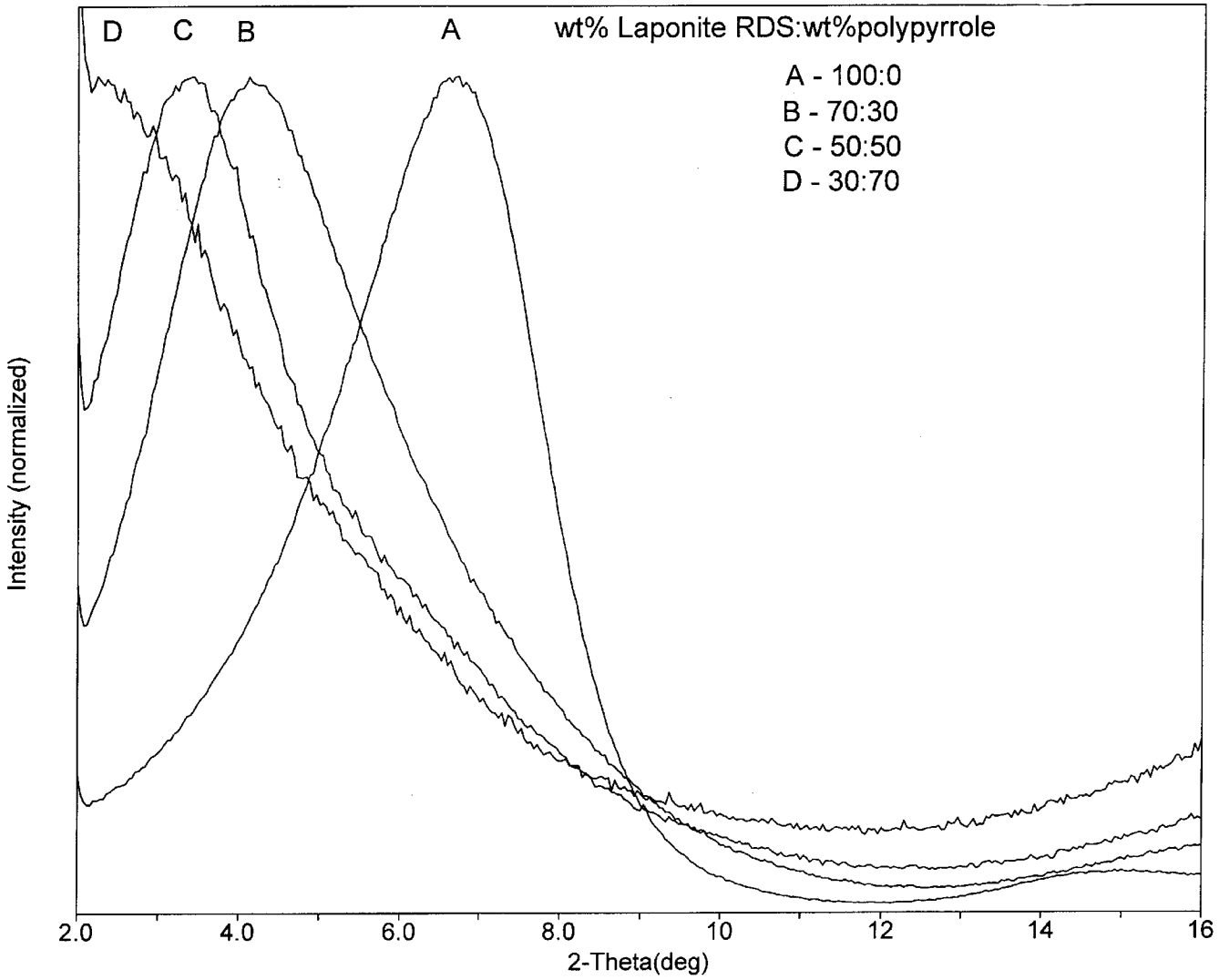
FIG. 1 shows the X-ray diffraction pattern of clay and electrically conducting polymer at various weight ratios.

For a better understanding of the present invention along with other advantages and capabilities thereof, reference is made to the following detailed description and claims in connection with the above described drawings.

DETAILED DESCRIPTION OF THE INVENTION

The antistatic layer of the present invention comprises a layered siliceous material, as component A, an electrically conducting polymer, that can intercalate inside and/or exfoliate the layered siliceous material, as component B and a film forming binder as component C.

Such an antistatic layer provides an electrical resistivity of less than 12 log ohms/square in relative humidity of from 50%–5%, but preferably less than 11 log ohms/square, and more preferably 10 log ohms/square. Additionally, such an antistatic layer provides adequate electrical resistivity values of less than 12 log ohms/square, preferably less than 11 log ohms/square, after undergoing typical color photographic processing.

In the present invention, the electrically conducting polymer is incorporated within a transparent, layered siliceous material, such as a smectite clay. This is accomplished by intercalating the electrically conducting polymer inside the layers of the siliceous material and/or exfoliating the siliceous material in presence of the electrically conducting polymer. The resultant material, in combination with a suitable polymeric binder, is incorporated in an imaging element, with improved optical and antistatic properties.

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche, especially CRT-exposed autoreversal and computer output microfiche films. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, polyethylene films, polypropylene films, glass, metal, paper (both natural and synthetic), polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly (vinylpyrrolidone), acrylamide polymers, and the like. A particularly common example of an image-forming layer is a gelatin-silver halide emulsion layer.

In order to promote adhesion between the conductive layer of this invention and the support, the support can be surface-treated by various processes including corona discharge, glow discharge, UV exposure, flame treatment, electron-beam treatment, as described in U.S. Pat. No. 5,718,995 or treatment with adhesion-promoting agents including dichloro- and trichloro-acetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like.

Further details with respect to the composition and function of a wide variety of different imaging elements are provided in U.S. Pat. No. 5,300,676 and references described therein which are incorporated herein by reference. All of the imaging processes described in the '676 patent, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

The antistatic coating compositions of the invention can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating. Alternatively, the antistatic layer or layers of the present invention can be applied to a single or multilayered polymeric web by any of the aforementioned methods, and the said polymeric web can subsequently be laminated (either directly or after stretching) to a film or paper support of an imaging element (such as those discussed above) by extrusion, calendering or any other suitable method.

The antistatic layer or layers of the present invention can be applied to the support in various configurations depending upon the requirements of the specific application. In the case of photographic elements, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. Alternatively, it can be applied over the imaging layers on either or both sides of the support, particularly for a thermally-processed imaging element. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The present invention can be used in conjunction with an intermediate layer, containing primarily binder and antihalation dyes, that functions as an antihalation layer. Alternatively, these could be combined into a single layer. Detailed description of antihalation layers can be found in U.S. Pat. No. 5,679,505 and references therein which are incorporated herein by reference. It is specifically contemplated that the antistatic layer can be a subbing layer underlying an abrasion resistant layer as described in 5,679,505 or the function of the antistatic layer can be included in an abrasion resistant layer. The combined function can be accomplished by substituting the resultant electrically conductive polymer intercalated/exfoliated siliceous material for the electrically conductive polymer desribed in copending and commonly assigned U.S. Ser. No. 09/173,409.

Typically, the antistatic layer may be used in a single or multilayer backing layer which is applied to the side of the support opposite to the sensitized emulsion. Such backing layers, which typically provide friction control and scratch, abrasion, and blocking resistance to imaging elements are commonly used, for example, in films for consumer imaging, motion picture imaging, business imaging, and others. In the case of backing layer applications, the antistatic layer can optionally be overcoated with an additional polymeric topcoat, such as, abrasion and scratch resistant polyurethanes, specifically those disclosed in U.S. Pat. No. 5,679,505 for motion picture films, a lubricant layer, and/or an alkali- removable carbon black-containing layer (as described in U.S. Pat. Nos. 2,271,234 and 2,327,828), for antihalation and camera- transport properties, and/or a transparent magnetic recording layer for information exchange, for example, and/or any other layer(s) for other functions.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

It is also contemplated that the electrically-conductive layer described herein can be used in imaging elements in which a relatively transparent layer containing magnetic particles dispersed in a binder is included. Transparent magnetic layers are well known and are described, for example, in U.S. Pat. No. 4,990,276, European Patent 459,349, and Research Disclosure, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical laydown.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove. Other addenda, such as polymer latices to improve dimensional stability, hardeners or crosslinking agents, and various other conventional additives can be present optionally in any or all of the layers of the various aforementioned imaging elements.

The antistatic layer of the present invention has a layered siliceous material, as component A, an electrically conducting polymer, that can intercalate inside and/or exfoliate the layered siliceous material, as component B and a film forming binder, as component C.

Preferred choice of component A includes various types of clay belonging to the general class of phyllosilicates. More preferred choice includes smectite clays, both natural and synthetic. One such material for this invention is a commercially available synthetic smectite clay which closely resembles the natural clay mineral hectorite in both structure and composition. Hectorite is a natural swelling clay which is relatively rare and occurs contaminated with other minerals such as quartz which are difficult and expensive to remove. Synthetic smectite is free from natural impurities, prepared under controlled conditions and commercially marketed under the tradename Laponite by Laporte Industries, Ltd of UK through its US subsidiary, Southern Clay Products, Inc. It is a 3-layered hydrous magnesium silicate, in which magnesium ions, partially replaced by suitable monovalent ions such as lithium, sodium, potassium and/or vacancies, are octahedrally bound to oxygen and/or hydroxyl ions, some of which may be replaced by fluorine ions, forming the central octahedral sheet; such an octahedral sheet is sandwiched between two tetrahedral sheets of silicon ions, tetrahedrally bound to oxygen.

There are many grades of Laponite such as RD, RDS, J, S, etc. each with unique characteristics and can be used for the present invention. Some of these products contain a polyphosphate peptizing agent such as tetrasodium pyrophosphate for rapid dispersion capability; alternatively, a suitable peptizer can be incorporated into Laponite later on for the same purpose. Typical chemical analyses of various grades of Laponite RDS and their physical properties, are disclosed in Laponite Product Bulletins.

Laponite separates into tiny platelets of lateral dimension of 25–50 nm and a thickness of 1–5 nm in deionized aqueous dispersions, commonly referred to as "sols." Typical concentration of Laponite in a sol can be 0.1 % through 10%. During dispersion in deionized water an electrical double layer forms around the clay platelets resulting in repulsion between them and no structure build up. However, in sols containing electrolytes introduced from tap water or other ingredients, the double layer can be reduced resulting in attraction between the platelets forming a "House of Cards" structure.

The interaction of clay particles with a polymer can result in the formation of three general types of structures as discussed by Lan et al (T. Lan, P. D. Kaviratna and T. J. Pinnavia, Chem. Mater.7,2144(1995)). (1) Conventional composites may contain clay with the layers unintercalated in a face-to-face aggregation. Here the clay platelet aggregates are simply dispersed with macroscopic segregation. (2) Intercalated clay composites are intercalation compounds of definite structure formed by the insertion of one or more molecular layers of polymer into the clay host galleries. (3) Finally, exfoliated clay-polymer composites where singular clay platelets are dispersed in a continuous polymer matrix. According to the present invention, the latter two arrangements of the clay in the electrically conducting polymer impart the desired properties to the antistatic layers.

Intercalation and exfoliation of clay can be conveniently monitored by measuring the basal (001) spacing of the clay platelets using x-ray diffraction technique, as illustrated in U.S. Pat. No. 5,554,670 and in copending applications U.S. Ser. Nos. 08/937,685 and 08/940,860. With intercalation of a polymer in the clay gallery, an increase in the basal spacing of the clay is observed. When completely exfoliated, the diffraction peaks disappear since the crystallographic order is lost.

Component B can be chosen from any or a combination of electrically-conducting polymers, specifically electronically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408), substituted or unsubstituted aniline-containing polymers (as mentioned in U.S. Pat. Nos. 5,716,550 and 5,093,439) and polyisothianapthene. The electrically conducting polymer may be soluble or dispersible in organic solvents or water or mixtures thereof. For environmental reasons, aqueous systems are preferred. Polyanions used in these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used. Preferred electrically conducting polymers for the present invention include polypyrrole styrene sulfonate (referred to as polypyrrole/poly (styrene sulfonic acid) in U.S. Pat. No. 5,674,654), 3,4-dialkoxy substituted polypyrrole styrene sulfonate, and 3,4-dialkoxy substituted polythiophene styrene sulfonate. The most preferred substituted electrically conductive polymers include poly(3,4-ethylene dioxypyrrole styrene sulfonate) and poly(3,4-ethylene dioxythiophene styrene sulfonate).

The film forming polymeric binders chosen as component C are preferably water processable polymers which may include water soluble polymers (e.g., polyvinyl alcohol, polyethylene oxide, polystyrene sulfonate, polyacrylamide), hydrophilic colloids (e.g., gelatin) or water insoluble latex polymers and interpolymers (e.g., those containing acrylics, styrenes, acrylonitriles, vinylidene halides, butadienes, olefins and others), or water dispersible condensation polymers (e.g., polyurethanes, polyesters, polyester ionomers, polyamides, epoxides), and the like. Particularly preferred latex polymers are vinylidene chloride containing polymers, polyesters, and polyurethanes.

For the current invention, it is preferred that the electrically conducting polymer (component B) is intercalated inside the layered siliceous material (component A) or the layered siliceous material (component A) is exfoliated in presence of the electrically conducting polymer (component B), as can be detected by X-ray diffraction techniques. In order to prevent undesirable interaction (e.g., flocculation, particulate formation, etc.) among the various constituents of the coating solution, it may be necessary to adjust their pH or ionic strength. Suitable agents for pH adjustment are ammonium hydroxide, sodium hydroxide, potassium hydroxide, triethyl amine, sulfuric acid, acetic acid, etc.

The antistatic layer can be optionally crosslinked or hardened by adding a crosslinking agent that reacts with functional groups present in any of the polymers, such as carboxyl groups. Crosslinking agents, such as aziridines, carbodiimides, epoxies, and the like are suitable for this purpose. The crosslinking agent can be used at about 0.5 to about 30 weight % based on the polymer. However, a crosslinking agent concentration of 2 to 12 weight % based on the polymer is preferred.

A suitable lubricating agent can be included in the layer of this invention to achieve a coefficient of friction that ensures good transport characteristics during manufacturing and customer handling. The desired values of the coefficient of friction and examples of suitable lubricating agents are disclosed in U.S. Pat. No. 5,679,505, and are incorporated herein by reference.

The relative weight ratio of the layered siliceous material (component A) to the electrically-conducting polymer (component B) can vary from 1:99 to 99:1 but preferably from 10:90 to 90:10. The relative weight % of the layered siliceous material (component A) in the dried antistatic layer can vary from 1–99% but preferably from 10–90%. The relative weight % of the electrically conductive polymer (component B) in the dried antistatic layer can vary from 1–99% but preferably from 10–90%. The relative weight % of the polymeric binder (component C) in the dried antistatic layer can vary from 1–99% but preferably from 10–90%. The coating composition is coated at a dry weight coverage of between 5 mg/m$^2$ and 10,000 mg/m$^2$, but preferably between 10–2000 mg/m$^2$.

In addition to components A, B and C, other components that are well known in the photographic art may also be present in the electrically-conductive antistatic layer. These additional components include: solvents, surfactants and coating aids, thickeners, coalescing aids, crosslinking agents or hardeners, soluble and/or solid particle dyes, antifoggants, matte beads, lubricants, and others.

X-ray Diffraction Studies of Intercalation and Exfoliation of Smectite Clay in Presence of Electrically Conducting Polymers The following are examples of intercalation of electrically conducting polymers (component B) inside smectite clay (component A). X-ray diffraction samples were prepared by drying appropriate aqueous mixtures on a glass slide.

Table I lists the (001) spacing of Laponite RDS clay when mixed with varying amounts of electrically conducting polypyrrole-containing polymers, derived from an aqueous dispersion of polypyrrole/poly (styrene sulfonic acid) prepared by oxidative polymerization of pyrrole in aqueous solution in the presence of poly (styrene sulfonic acid) using ammonium persulfate as the oxidant (henceforth referred to as polypyrrole), following U.S. Pat. No. 5,674,654. It is clear that the incorporation of increasing amount of polypyrrole in the mixture increases the (001) spacing of Laponite RDS indicating intercalation of the polymer in the clay gallery. The X-ray diffraction patterns are shown in FIG. 1. The shift in the main (001) peak towards lower 2-theta with increasing amount of polypyrrole illustrates the increase in basal plane spacing, and, thus intercalation of polypyrrole in the clay lattice.

TABLE I

Laponite RDS: Polypyrrole (001) spacing

| weight % of Laponite RDS | weight % of polypyrrole | Basal plane (001) spacing, Angstroms @ 42% RH |
|---|---|---|
| 100 | 0 | 13.1 |
| 70 | 30 | 21.4 |
| 50 | 50 | 26.0 |
| 30 | 70 | 40.0 |

Figure 2:
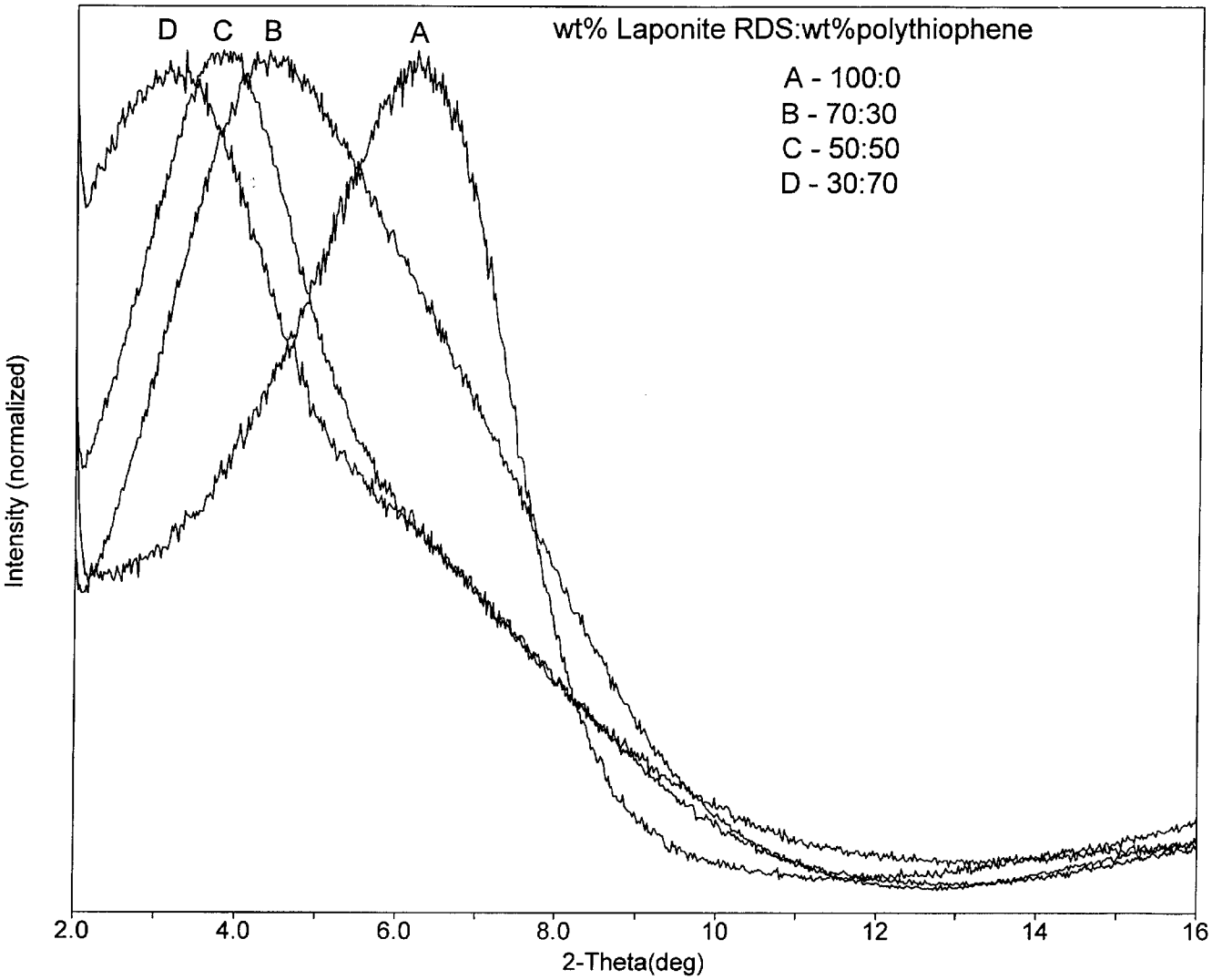
FIG. 2 shows the X-ray diffraction pattern of clay and electrically conducting polymer at various weight ratios.

Table II lists the (001) spacing of Laponite RDS clay when mixed with varying amounts of electrically conducting polyethylene dioxythiophene polystyrene sulfonate (henceforth referred to as polythiophene), commercially supplied by Bayer Corporation as Baytron P. It is clear that the incorporation of increasing amount of polythiophene in the mixture increases the (001) spacing of Laponite RDS indicating intercalation of the polymer in the clay gallery. The X-ray diffraction patterns are shown in FIG. 2. The shift in the main (001) peak towards lower 2-theta with increasing amount of polythiophene illustrates the increase in basal plane spacing, and, thus intercalation of polythiophene in the clay lattice.

TABLE II

Laponite RDS: Polythiophene (001) spacing

| weight % of Laponite RDS | weight % of polythiophene | Basal plane (001) spacing, Angstroms @ 60% RH |
|---|---|---|
| 100 | 0 | 14.2 |
| 70 | 30 | 19.8 |
| 50 | 50 | 23.2 |
| 30 | 70 | 28.1 |

The X-ray diffraction data clearly indicate that electrically conducting polymers such as polypyrrole and polythiophene (component B) do indeed intercalate inside a layered siliceous material such as smectite clay (component A). Therefore, these materials are suitable for use in the present invention.

The present invention is further illustrated by the following examples of its practice. However, the scope of this invention is by no means restricted to these specific examples.

SAMPLE PREPARATION

Layered siliceous material (component A)

The layered siliceous material (component A) used in the following samples is a commercially available synthetic smectite clay, Laponite RDS, supplied by Southern Clay Products.

Electrically conducting polymer (component B)

The electrically conducting polymer (component B) used in the following samples is a polypyrrole derivative. The conducting polypyrrole is derived from an aqueous dispersion of polypyrrole/poly (styrene sulfonic acid) prepared by oxidative polymerization of pyrrole in aqueous solution in the presence of poly (styrene sulfonic acid) using ammonium persulfate as the oxidant, following U.S. Pat. No. 5,674,654. This electrically conducting polymer is henceforth referred to as polypyrrole.

Polymeric binder (component C)

The polymeric binder (component C) used in the following samples is either latex polymer X which is a terpolymer of acrylonitrile, vinylidene chloride and acrylic acid in the weight ratio of 15/79/6 and having a glass transition temperature of 42° C. or latex polymer Y which is a terpolymer of methyl acrylate, vinylidene chloride and itaconic acid in the weight ratio 15/83/2 and having a glass transition temperature of 24° C.

Preparation of coating solution for working examples

Aqueous sol of Laponite RDS (component A) and aqueous dispersion of Polypyrrole (component B) after pH adjustment were mixed in a dry weight ratio of Laponite RDS: Polypyrrole of 30:70 and stirred for 24 hours to allow sufficient intercalation of polypyrrole in the Laponite RDS lattice. The resultant was subsequently mixed with an aqueous dispersion of latex X or Y (component C) to obtain a 4% solids dispersion where the dry weight ratio of component A; component B: component C was maintained at 7.5:17.5:75. Such a dispersion was stirred for 12 hours until coating on a film based web.

Film based web

Poly(ethylene terephthalate) or PET film base that had been previously coated with a subbing layer of vinylidene chloride-acrylonitrile-acrylic acid terpolymer latex was used as the web on which aqueous coatings were applied by a suitable coating method. The coatings were dried nominally at 100° C. The coating coverage varied between 300 mg/m$^2$ and 1000 mg/m$^2$ when dried.

TEST METHODS

For resistivity tests, samples were preconditioned at 50% RH 22° C. for at least 24 hours prior to testing. Surface electrical resistivity (SER) was measured with a Kiethley Model 616 digital electrometer using a two point DC probe by a method similar to that described in U.S. Pat. No. 2,801,191. Internal resistivity or "water electrode resistivity" (WER) was measured where the by the procedures described in R. A. Elder, "Resistivity Measurements on Buried Conductive Layers", EOS/ESD Symposium proceedings, September 1990, pages 251–254. In the tables hereinbelow, with details about the various samples, the SER values are reported for samples with outermost antistatic layers, and WER values are reported for those with antistatic layers subsequently overcoated with a protective topcoat.

Dry adhesion was evaluated by scribing a small cross-hatched region into the coating with a razor blade. A piece of high-tack adhesive tape was placed over the scribed region and quickly removed. The relative amount of coating removed is a qualitative measure of the dry adhesion.

Total optical and ultraviolet densities ($D_{min}$) were evaluated at 530 nm and 380 nm, respectively with a X-Rite Model 361T densitometer. Net or Delta UV $D_{min}$ and Delta ortho $D_{min}$ values were calculated by correcting the total optical and ultraviolet densities for the contributions of the uncoated support which then corresponds to the contribution of either the combined conductive and protective layers in the case of multilayer backings or of the single-layer backings.

WORKING EXAMPLES

Samples 1–3 were prepared with Laponite RDS as component A, Polypyrrole as component B and latex X as component C, in accordance with the present invention. Sample 4 was coated similar to sample 2 but was additionally overcoated with a protective topcoat of Witcobond 232, a commercially available aliphatic polyurethane which satisfies the criteria specified in U.S. Pat. No. 5,679,505, for application as an abrasion resistant backing for motion picture print films. Samples 5–7 were prepared similar to samples 1–3, respectively, but with latex Y (instead of latex X) as component C, in accordance with the present invention. The details about these samples and the corresponding SER (for samples 1–3 and 5–7) and WER (for sample 4) values, before and after a typical C-41 color photographic processing, are provided in Table III. It is clear, that all these samples, prepared in accordance with the present invention retain sufficient conductivity even after color processing to be effective as "process-surviving" antistatic layers. Results obtained from sample 4 demonstrate that the antistatic layer of the present invention can be overcoated with an abrasion and scratch resistant polyurethane topcoat with specific mechanical properties per U.S. Pat. No. 5,679,505, for applications in motion picture print films.

COMPARATIVE SAMPLES

Samples Comp. 1 and 2 were prepared similar to samples 1 and 5, respectively, of working examples (which were prepared as per the present invention) but containing only the electrically conducting polypyrrole (component B) and the polymeric binder latex X (for Comp. 1) or Y (for Comp. 2) but no layered siliceous material (component A) as required by the present invention. The dry weight ratio of polypyrrole:binder was so chosen for Comp. 1 and 2 as to match the Net or Delta UV $D_{min}$ and Delta ortho $D_{min}$ values of working examples, samples 1 and 5, respectively, to ensure similar optical performance for all four samples. Details about these comparative samples and the corresponding SER values, before any photographic processing, are listed in Table IV. It is clear that samples Comp. 1 and 2 have inferior conductivity compared to samples 1 and 5, prepared as per the present invention.

Samples Comp. 3–5 were prepared containing only Laponite RDS (component A) and the polymeric binder latex X (component C) but no electrically conducting polymer (component B). Sample Comp. 6 was prepared similar to sample Comp. 5 but was additionally overcoated with a protective polyurethane topcoat of Witcobond 232, similar to sample 4 of working examples. Sample Comp. 7 and 8 were prepared similar to samples Comp. 4 and 5, respectively, but with polymeric binder latex Y (instead of X). Sample Comp. 9 was prepared similar to sample Comp. 6, wherein the antistatic layer was additionally overcoated with a protective polyurethane topcoat of Witcobond 232. The details about all these comparative samples and the corresponding SER (for samples Comp. 3–5 and 7 and 8) and WER (for samples Comp. 6 and 9) values are listed in Table IV. It is clear that samples Comp. 3, 4 and 7 have inferior SER values compared to any of the samples prepared in accordance with the present invention, even though the comparative samples contained higher amount of Laponite RDS than the working examples. Although at 30 weight percent of Laponite RDS, the SER values of the comparative samples (Comp. 5 and Comp. 8) improved, when these comparative samples were overcoated with a protective polyurethane topcoat, in a way similar to sample 4 of working examples, the WER attained an unacceptably high level (Comp. 6 and Comp. 9). This indicates that in the absence of an electrically conducting polymer, as specified in the present invention, the antistatic layers have either inferior conductivity or they lose conductivity when overcoated with an abrasion resistant polyurethane topcoat, as recommended in U.S. Pat. No. 5,679,505 for applications in motion picture print films. None of the samples Comp. 3–5, 7 and 8 provided any significant conductivity, after C-41 color processing, further illustrating their inferiority to the samples prepared in accordance with the present invention.

TABLE III

WORKING EXAMPLES

| | antistat. layer composition dry wt. % of components | | | antistat. dry | topcoat dry | pre-processing | post C-41 processing |
|---|---|---|---|---|---|---|---|
| sample | comp. A Laponite | comp. B polypyrrole | comp. C | coverage mg/m$^2$ | coverage mg/m$^2$ | SER/WER log Ω/□ | SER/WER log Ω/□ |
| | | | latex X | | | | |
| 1 | 7.5 | 17.5 | 75 | 300 | none | 9.1 | 10.6 |
| 2 | 7.5 | 17.5 | 75 | 600 | none | 8.1 | 9.7 |
| 3 | 7.5 | 17.5 | 75 | 1000 | none | 7.8 | 9.3 |
| 4 | 7.5 | 17.5 | 75 | 600 | 1000 | 7.9 | 8.9 |
| | | | latex Y | | | | |
| 5 | 7.5 | 17.5 | 75 | 300 | none | 8.9 | 10.5 |
| 6 | 7.5 | 17.5 | 75 | 600 | none | 7.9 | 9.3 |
| 7 | 7.5 | 17.5 | 75 | 1000 | none | 7.9 | 8.8 |

TABLE IV

COMPARATIVE EXAMPLES

| | antistat. layer composition dry wt. % of components | | | antistat. dry | topcoat dry | pre-processing | post C-41 processing |
|---|---|---|---|---|---|---|---|
| sample | comp. A Laponite | comp. B polypyrrole | comp. C | coverage mg/m$^2$ | coverage mg/m$^2$ | SER/WER log Ω/□ | SER/WER log Ω/□ |
| | | | latex X | | | | |
| Comp. 1 | 0 | 5 | 95 | 600 | none | >13.9 | |
| | | | latex Y | | | | |
| Comp. 2 | 0 | 5 | 95 | 600 | none | 11.9 | |
| | | | latex X | | | | |
| Comp. 3 | 10 | 0 | 90 | 600 | none | 13.3 | >13.9 |
| Comp. 4 | 15 | 0 | 85 | 600 | none | 12.6 | >13.9 |
| Comp. 5 | 30 | 0 | 70 | 600 | none | 9.5 | >13.9 |
| Comp. 6 | 30 | 0 | 70 | 600 | 1000 | >13 | |
| | | | latex Y | | | | |
| Comp. 7 | 15 | 0 | 85 | 600 | none | 11.8 | >13.9 |
| Comp. 8 | 30 | 0 | 70 | 600 | none | 8.9 | >13.9 |
| Comp. 9 | 30 | 0 | 70 | 600 | 1000 | >13 | |

The invention has been described in detail with particular reference to certain preferred embodiments thereof, but it will be understood that variations and modifications can be effected within the spirit and scope of the invention.

What is claimed is:

1. An imaging element comprising:

a support;

an image-forming layer superposed on the support; and an electrically-conductive layer superposed on the support; said electrically-conductive layer comprising a layered siliceous material, an electrically conducting polymer that can intercalate inside or exfoliate said layered siliceous material and a film-forming binder.

2. The imaging element of claim 1 wherein the support is selected from the group consisting of cellulose nitrate film, cellulose acetate film, poly(vinyl acetal) film, polystyrene film, poly(ethylene terephthalate) film, poly(ethylene naphthalate) film, polycarbonate film, polyethylene film, polypropylene film, glass, metal and paper.

3. The imaging element of claim 1 wherein the layered siliceous material comprises a phyllosilicate clay.

4. The imaging element of claim 1 wherein the layered siliceous material comprises a smectite clay.

5. The imaging element of claim 1 wherein the electrically-conducting polymer comprises substituted pyrrote-containing polymers, unsubstituted pyrrole-containing polymers, substituted thiophene-containing polymers, unsubstituted thiophene-containing polymers, substituted aniline-containing polymers and unsubstituted aniline-containing polymers.

6. The imaging element of claim 1 wherein the film forming binder is selected from the group consisting of water soluble polymers, hydrophilic colloids, water insoluble latex polymers and water dispersible condensation polymers.

7. The imaging element of claim 1 wherein the electrically-conducting layer further comprises a crosslinking agent.

8. The imaging element of claim 1 wherein the crosslinking agent is present at a concentration of 2 to 12 weight % based on the-film forming binder.

9. The imaging element of claim 1 wherein the electrically-conducting layer further comprises a lubricating agent.

10. The imaging element of claim 1 wherein the layered siliceous material comprises from 1–99 weight % of the electrically conducting layer.

11. The imaging element of claim 1 wherein the electrically-conducting polymer comprises from 1–99 weight % of the electrically conducting layer.

12. The imaging element of claim 1 wherein the film-forming binder comprises from 99–1 weight % of the electrically-conductive layer.

13. The imaging element of claim 1 wherein the electrically conductive layer comprises a dry weight coverage of between 5 $mg/m^2$ and 10,000 $mg/m^2$.

14. The imaging element of claim 1 wherein the electrically conducting layer further comprises solvents, surfactants, coating aids, thickeners, coalescing aids, particle dyes, antifoggants or matte beads.

15. The imaging element of claim 1 further comprising an abrasion resistant layer superposed on said electrically-conductive layer.

16. An imaging element comprising:

a support;

an image-forming layer superposed on the support; and an electrically-conductive layer superposed on the support; said electrically-conductive layer comprising a smectite clay, a 3,4-dialkoxy substituted polythiophene styrene sulfonate that can intercalate inside or exfoliate said smectite clay and a film-forming binder.

17. An imaging element comprising:

a support;

an image-forming layer superposed on the support; and an electrically-conductive layer superposed on the support; said electrically-conductive layer comprising a smectite clay, a polypyrrole styrene sulfonate or a 3,4-dialkoxy substituted polypyrrole styrene sulfonate that can intercalate inside or exfoliate said smectite clay and a film-forming binder.

* * * * *

UNITED STATES PATENT AND TRADEMARK OFFICE

CERTIFICATE OF CORRECTION

PATENT NO. : 6,025,119
DATED : February 15, 2000
INVENTOR(S) : Debasis Majumdar et al.

It is certified that error appears in the above-identified patent and that said Letters Patent is hereby corrected as shown below:

Column 17, claim 5,
Line 27, change pyrrote to pyrrole.

Signed and Sealed this

Twenty-ninth Day of January, 2002

*Attest:*

*Attesting Officer*

JAMES E. ROGAN
*Director of the United States Patent and Trademark Office*